US010051387B2

(12) United States Patent
Udesen et al.

(10) Patent No.: US 10,051,387 B2
(45) Date of Patent: Aug. 14, 2018

(54) HEARING DEVICE WITH ADAPTIVE PROCESSING AND RELATED METHOD

(71) Applicant: GN Hearing A/S, Ballerup (DK)

(72) Inventors: Jesper Udesen, Ballerup (DK); Jesper Bünsow Boldt, Ballerup (DK)

(73) Assignee: GN HEARING A/S, Ballerup (DK)

( * ) Notice: Subject to any disclaimer, the term of this patent is extended or adjusted under 35 U.S.C. 154(b) by 80 days.

(21) Appl. No.: 15/217,881

(22) Filed: Jul. 22, 2016

(65) Prior Publication Data

US 2018/0020297 A1 Jan. 18, 2018

(30) Foreign Application Priority Data

Jul. 15, 2016 (EP) ..... 16179726

(51) Int. Cl.
*H04R 25/00* (2006.01)

(52) U.S. Cl.
CPC ..... *H04R 25/554* (2013.01); *H04R 25/407* (2013.01); *H04R 2225/41* (2013.01); *H04R 2225/43* (2013.01); *H04R 2225/51* (2013.01); *H04R 2420/07* (2013.01)

(58) Field of Classification Search
CPC ..... H04R 25/00
See application file for complete search history.

(56) References Cited

U.S. PATENT DOCUMENTS

| | | | | |
|---|---|---|---|---|
| 8,867,763 | B2 | 10/2014 | Bouse | |
| 2010/0074460 | A1* | 3/2010 | Marzetta | G02C 11/06 381/313 |
| 2011/0091056 | A1* | 4/2011 | Nishizaki | H04R 25/43 381/312 |
| 2015/0016644 | A1 | 1/2015 | Strelcyk et al. | |

FOREIGN PATENT DOCUMENTS

| | | | |
|---|---|---|---|
| DE | 10 2012 214081 | A1 | 12/2013 |
| EP | 1 530 402 | A2 | 5/2005 |
| EP | 1 530 402 | A3 | 10/2007 |
| JP | 2000 059893 | A | 2/2000 |

OTHER PUBLICATIONS

Extended European Search Report dated Feb. 14, 2017 for corresponding EP Patent Application No. 16179726.1, 8 pages.

* cited by examiner

*Primary Examiner* — Olisa Anwah
(74) *Attorney, Agent, or Firm* — Vista IP Law Group, LLP

(57) ABSTRACT

A hearing device includes: an antenna for converting a first wireless input signal of a first external source to an antenna output signal; a radio transceiver for converting the antenna output signal to a transceiver input signal; a set of microphones comprising a first microphone for provision of a first microphone input signal; a pre-processing unit connected to the radio transceiver and the first microphone for pre-processing the transceiver input signal and the first microphone input signal; a processor for processing input signals and providing an electrical output signal based on the input signals; a receiver for converting the electrical output signal to an audio output signal; and a processing controller comprising a direction estimator configured to estimate a head direction of a user of the hearing device; wherein the hearing device is configured to select and apply a processing scheme based on the estimated head direction.

19 Claims, 7 Drawing Sheets

HEARING DEVICE WITH ADAPTIVE PROCESSING AND RELATED METHOD

RELATED APPLICATION DATA

This application claims priority to, and the benefit of, European Patent Application No. 16179726.1 filed on Jul. 15, 2016, pending. The entire disclosure of the above application is expressly incorporated by reference herein.

FIELD

The present disclosure relates to a hearing device with adaptive processing and a method of operating a hearing device. In particular, the present disclosure relates to hearing devices with wireless audio streaming from external source(s).

BACKGROUND

Wireless communication to and from hearing devices has been increasing in continuation of the developments within wireless communication technology. However, the new technologies entail new challenges for the hearing aid manufacturers in order to imitate normal hearing and the human brains perception of sound. Wirelessly connecting hearing device(s) to an external microphone makes it possible to get an audio stream from an external sound source streamed directly to the ear. This is an efficient way of improving the perception of the external sound source and the signal to noise ratio (SNR). However, this approach implies that the hearing impaired person is locked to that source and cannot easily focus on other sound sources.

SUMMARY

Accordingly, there is a need for devices and methods enabling a hearing aid user to conveniently communicate with other sound sources or persons while receiving wireless audio streams.

A hearing device is disclosed, the hearing device comprising an antenna for converting a first wireless input signal of a first external source to an antenna output signal; a radio transceiver coupled to the antenna for converting the antenna output signal to a transceiver input signal; a set of microphones comprising a first microphone for provision of a first microphone input signal; an optional pre-processing unit connected to the radio transceiver and the first microphone for pre-processing the transceiver input signal and the first microphone input signal; a processor for processing input signals and providing an electrical output signal based on input signals; a receiver for converting the electrical output signal to an audio output signal, and a processing controller comprising a direction estimator configured to estimate a head direction of a user of the hearing device. The hearing device is configured to select and apply a processing scheme in the hearing device based on the estimated head direction.

Further, a method of operating a hearing device is provided, the method comprising: receiving a first wireless input signal of a first external source and converting the first wireless input signal to a transceiver input signal; receiving an audio signal and converting the audio signal to one or more microphone input signals including a first microphone input signal; estimating a head direction of a user of the hearing device; and selecting and applying a processing scheme in the hearing device based on the estimated head direction.

It is an important advantage that a user in a wireless streaming environment is able to direct listening focus to other speakers or speakers not wearing a spouse microphone.

Further, being able to easily switch between external sources will make the hearing aid user less isolated and less excluded from the environment. If multiple external sources are available, the hearing aid user will be able to switch between the sources easily. Further, the proposed solution is not dependent on placing an external microphone close to the source of interest. Distributed array processing can potential make it possible to separate different sources in a certain location. The separated sources can be streamed to the hearing aid and selected by the hearing aid users look direction/head direction.

A hearing device includes: an antenna for converting a first wireless input signal of a first external source to an antenna output signal; a radio transceiver coupled to the antenna for converting the antenna output signal to a transceiver input signal; a set of microphones comprising a first microphone for provision of a first microphone input signal; a pre-processing unit connected to the radio transceiver and the first microphone for pre-processing the transceiver input signal and the first microphone input signal; a processor for processing input signals and providing an electrical output signal based on the input signals; a receiver for converting the electrical output signal to an audio output signal; and a processing controller comprising a direction estimator configured to estimate a head direction of a user of the hearing device; wherein the hearing device is configured to select and apply a processing scheme in the hearing device based on the estimated head direction.

Optionally, the direction estimator is configured to estimate the head direction of the user of the hearing device based on the transceiver input signal and the first microphone input signal.

Optionally, the direction estimator is configured to estimate the head direction relative to the first external source.

Optionally, the hearing device is configured to apply the processing scheme in the hearing device by applying a transceiver gain to the transceiver input signal in the pre-processing unit.

Optionally, the hearing device is configured to apply the processing scheme in the hearing device by applying a first microphone gain to the first microphone input signal in the pre-processing unit.

Optionally, the transceiver input signal comprises a first transceiver input signal associated with the first external source and a second transceiver input signal associated with a second external source; and wherein the hearing device is configured to apply the processing scheme in the hearing device by applying a first transceiver gain to the first transceiver input signal and a second transceiver gain to the second transceiver input signal.

Optionally, the hearing device further includes a beamformer, wherein the hearing device is configured to apply the processing scheme by applying a directional mode to microphone signal(s) in the beamformer.

Optionally, the hearing device is configured to apply the processing scheme based on the estimated head direction by applying a first processing scheme in the hearing device if the estimated head direction is within a first angular range, and applying a second processing scheme in the hearing device different from the first processing scheme if the estimated head direction is within a second angular range.

Optionally, the hearing device further includes a voice activity detector configured to detect first voice activity associated with the first external source; wherein the hearing device is configured to select and apply the processing scheme in the hearing device based on the first voice activity associated with the first external source.

A method of operating a hearing device includes: receiving a first wireless input signal of a first external source and converting the first wireless input signal to a transceiver input signal; receiving an audio signal and converting the audio signal to one or more microphone input signals including a first microphone input signal; estimating a head direction of a user of the hearing device; and selecting and applying a processing scheme in the hearing device based on the estimated head direction.

Optionally, the act of estimating the head direction is performed based on the transceiver input signal and the first microphone input signal.

Optionally, the act of applying the processing scheme comprises applying a transceiver gain to the transceiver input signal in a pre-processing unit of the hearing device.

Optionally, the act of applying the processing scheme comprises applying a first microphone gain to the first microphone input signal in a pre-processing unit of the hearing device.

Optionally, the method further includes receiving a second wireless input signal of a second external source; wherein the transceiver input signal comprises a first transceiver input signal originating associated with the first external source and a second transceiver input signal associated with the second external source; and wherein the act of applying the processing scheme comprises applying a first transceiver gain to the first transceiver input signal and a second transceiver gain to the second transceiver input signal.

Optionally, the act of applying the processing scheme based on the estimated head direction comprises: applying a first processing scheme in the hearing device if the estimated head direction is within a first angular range, and applying a second processing scheme different from the first processing scheme if the estimated head direction is within a second angular range.

Other features, advantageous, and embodiments will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
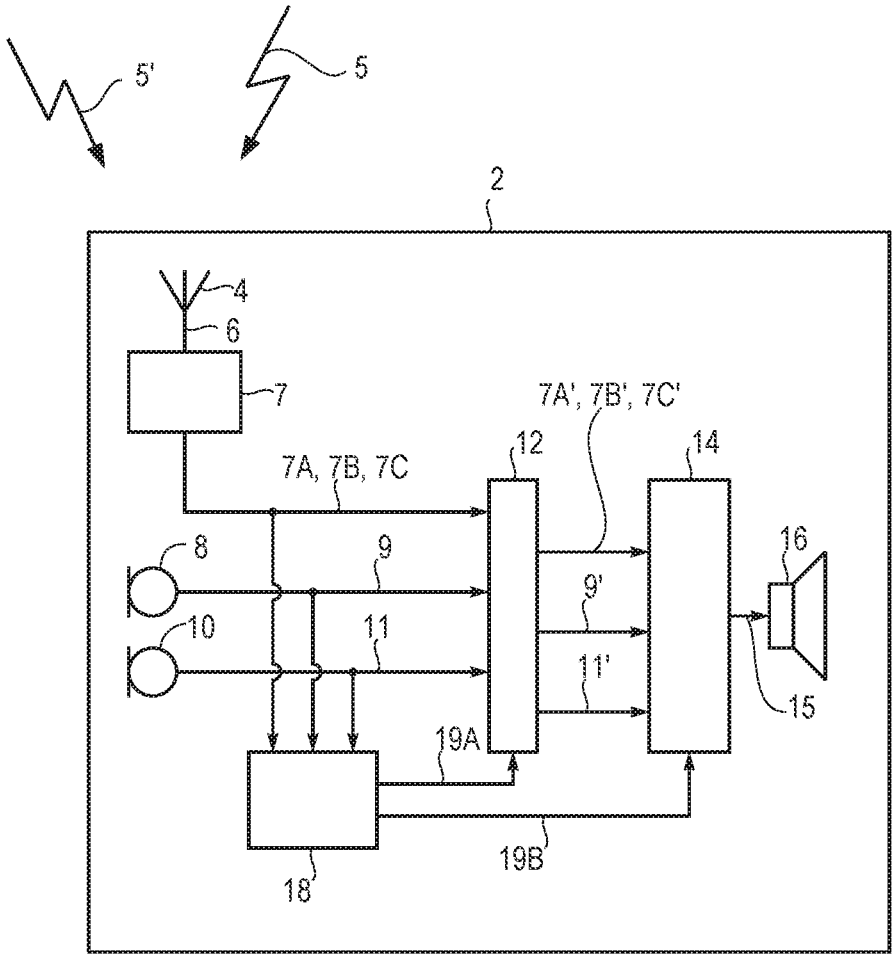
FIG. 1 schematically illustrates an exemplary hearing device.

Various embodiments are described hereinafter with reference to the figures. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A hearing device is disclosed. The hearing device may be a hearing aid, wherein the processor is configured to compensate for a hearing loss of a user.

The hearing device comprises an antenna for converting one or more wireless input signals, e.g. a first wireless input signal and/or a second wireless input signal, to an antenna output signal. The wireless input signal(s) origin from external source(s), such as spouse microphone device(s), wireless TV audio transmitter, and/or a distributed microphone array associated with a wireless transmitter.

The hearing device comprises a radio transceiver coupled to the antenna for converting the antenna output signal to a transceiver input signal. Wireless signals from different external sources may be multiplexed in the transceiver to a transceiver input signal or provided as separate transceiver input signals on separate transceiver output terminals of the transceiver. The hearing device may comprise a plurality of antennas and/or an antenna may be configured to be operate in one or a plurality of antenna modes. The transceiver input signal comprises a first transceiver input signal representative of the first wireless signal from the first external source.

The hearing device comprises a set of microphones. The set of microphones may comprise one or more microphones. The set of microphones comprises a first microphone for provision of a first microphone input signal and/or a second microphone for provision of a second microphone input signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone input signal The hearing device comprises a pre-processing unit. The pre-processing unit may be connected to the radio transceiver for pre-processing the transceiver input signal. The pre-processing unit may be connected the first microphone for pre-processing the first microphone input signal. The pre-processing unit may be connected the second microphone if present for pre-processing the second microphone input signal.

The pre-processing unit may comprise one or more transceiver gain units for applying transceiver gains to respective transceiver inputs signals, e.g. based on a pre-processing control signal. A transceiver gain unit may be a switch, thus applying a gain of zero ("off") or one ("on") to the transceiver input signal. A transceiver gain unit may be an amplifier unit, e.g. configured to apply a transceiver gain in the range from zero to one and/or a transceiver gain larger than one.

In one or more exemplary hearing devices, the pre-processing unit comprises a first transceiver gain unit applying a first transceiver gain also denoted GT1 to the first transceiver input signal based on the pre-processing control signal. The pre-processing unit may comprise a second transceiver gain unit applying a second transceiver gain also denoted GT2 to the second transceiver input signal based on the pre-processing control signal. The pre-processing unit may comprise a common transceiver gain unit applying a common transceiver gain also denoted GTC to the transceiver input signal based on the pre-processing control signal.

The pre-processing unit may comprise one or more microphone gain units for applying microphone gains to respective microphone inputs signals, e.g. based on a pre-processing control signal. A microphone gain unit may be a switch, thus applying a gain of zero ("off") or one ("on") to the microphone input signal. A microphone gain unit may be an amplifier unit, e.g. configured to apply a microphone gain in the range from zero to one and/or a microphone gain larger than one.

In one or more exemplary hearing devices, the pre-processing unit comprises a first microphone gain unit applying a first microphone gain also denoted GM1 to the first microphone input signal based on the pre-processing control signal. The pre-processing unit may comprise a second microphone gain unit applying a second microphone gain also denoted GM2 to the second microphone input signal based on the pre-processing control signal.

The hearing device comprises a processor for processing input signals, such as pre-processed transceiver input signal and/or pre-processed microphone input signal(s). The processor provides an electrical output signal based on the input signals to the processor. Input terminal(s) of the processor are optionally connected to respective output terminals of the pre-processing unit. For example, a transceiver input terminal of the processor may be connected to a transceiver output terminal of the pre-processing unit. One or more microphone input terminals of the processor may be connected to respective one or more microphone output terminals of the pre-processing unit.

The hearing device comprises a processing controller comprising a direction estimator configured to estimate a head direction of a user of the hearing device, e.g. relative to an external source, such as the first external source. To estimate a head direction of a user of the hearing device may comprise to estimate a first head direction relative to a first external source. The first head direction relative to a first external source is also denoted V1. To estimate a head direction of a user of the hearing device may comprise to estimate a second head direction relative to a second external source. The second head direction relative to a second external source is also denoted V2. To estimate a head direction of a user of the hearing device may comprise to estimate a third head direction (V3) relative to a third external source.

The direction estimator may be configured to estimate a head direction of a user of the hearing device based on the transceiver input signal and/or the first microphone input signal. To estimate a head direction of a user of the hearing device may be based on a second microphone input signal from a second microphone. To estimate a head direction of a user of the hearing device may be based on a third microphone input signal from a third microphone. To estimate a head direction of a user of the hearing device may be based on a beamformed microphone input signal, wherein the beamformed microphone input signal is based on the first microphone input signal and a second microphone input signal from a second microphone.

The direction estimator may comprise an estimation beamformer for provision of a beamformed microphone input signal. The output of the estimation beamformer may be connected to an input of the signal correlation unit. The estimation beamformer may be configured to apply a set of directional estimation modes to the microphone input signal(s) for forming beamformed microphone input signal(s), e.g. in parallel, and feed the beamformed microphone input signal(s) to the correlation unit for correlating the beamformed microphone input signal(s) with the transceiver input signal or parts thereof, such as the first transceiver input signal and/or the second transceiver input signal. The set of directional estimation modes of the estimation beamformer may comprise a first estimation mode and a second estimation mode, wherein the first estimation mode has a main loop in a first direction and the second estimation mode has a main loop in a second direction. The set of estimation modes may comprise a suitable number of estimation modes, such as three, four, five or more estimation modes.

The direction estimator may comprise a signal correlation unit configured to correlate a transceiver input signal and one or more microphone input signals, such as the first microphone input signal, the second microphone input signal and/or beamformed microphone input signal(s). A correlation output of the signal correlation unit is fed to a control unit of the processing controller, and the control unit provides one or more control signals based on the correlation output. A correlation output may comprise one or more correlation values including a first correlation value being the result of a signal correlation of a transceiver input signal and a beamformed microphone input signal, such as a first beamformed microphone input signal formed by application of a first estimation mode in the estimation beamformer. The correlation output may comprise a second correlation value being the result of a signal correlation of a transceiver input signal and a second beamformed microphone input signal formed by application of a second estimation mode in the estimation beamformer.

The direction estimator may comprise a control unit configured to receive a correlation output and determine a head direction based on the correlation output. For example, the control unit may determine the head direction by comparing correlation values of the correlation output. The control unit may identify the head direction as the main loop direction of the estimation mode of the estimation beamformer resulting in the highest (or lowest) correlation value. The control unit may identify the head direction as a weighting or interpolation based on main loop directions of one or more estimation modes, for example the two or three estimation modes resulting in the highest (or lowest) correlation values. In one or more exemplary hearing devices, the control unit is configured to estimate a head direction based on an adaptive beamforming scheme, where the control unit controls the estimation beamformer (estimation mode parameters) in order to cancel a reference signal, e.g. by minimizing a correlation value of correlation output, the correlation value being the result of signal correlation between a beamformed microphone input signal and a transceiver input signal, the control unit controlling the estimation mode (and thereby the main loop direction identified as the head direction) applied in the estimation beamformer.

The hearing device is configured to select and apply a processing scheme in the hearing device based on the head direction. For example, the processing controller may control the pre-processing unit based on the head direction, e.g. via a pre-processing control signal in order to control or set one or more operating parameters of the pre-processing unit. The processing controller may control the processor based on the head direction, e.g. via a processor control signal in order to control or set one or more operating parameters of the processor. The processing controller may comprise a controller unit configured to provide control signal(s) to the pre-processing device, the processor and/or the beamformer for selecting and applying a processing scheme in the hearing device.

The processing controller may comprise an accelerometer or receive input from an accelerometer, e.g. arranged in another hearing device of a binaural hearing system, and estimate the head direction based on accelerometer input to the direction estimator. Use of an accelerometer for head direction estimation may increase the time resolution and provide a more accurate head direction estimation.

The processing controller may be configured to determine a transceiver gain for the transceiver input signal, e.g. based on the estimated head direction. The processing controller may be configured to determine a first transceiver gain for the first transceiver input signal based on the estimated head direction relative to a first external source. The processing controller may be configured to determine a second transceiver gain for the second transceiver input signal based on the estimated head direction relative to a second external source. A transceiver gain may be determined by selecting a transceiver gain value from a table based on a ranging of the estimated head direction. A transceiver gain may be determined by calculating a transceiver gain value by a transceiver gain function having the estimated head direction as input.

In the hearing device, to apply a processing scheme may comprise to apply a transceiver gain to the transceiver input signal, e.g. in the pre-processing unit. Thereby, the hearing device is able to control the amplitude/volume of the transceiver input signal. For example, the hearing aid may be able to mute or attenuate the transceiver input signal if a user directs his/her attention away from a TV with a wireless streaming unit. Further, the hearing aid is able to attenuate and/or amplify the transceiver input signal without affecting the general hearing aid processing in the processor. The gain applied to the transceiver input signal may be 1 when the hearing device user looks at the external sound source and/or the gain may be <<1 when the hearing device user does not look at the sound source. There may be a smooth transition over angle between the maximum and minimum gain values. This could e.g. be obtained with a Hanning window.

In the hearing device, to apply a processing scheme may comprise to apply HRTF (head-related-transfer-function) information to the transceiver input signal(s), e.g. in the pre-processing unit. Thereby realistic and natural spatial impression of the external sound source is created. However, in some listening situations true spatial sound may not be desirable, e.g. in a situation where several external sound sources are present and the resulting hearing device signal becomes too complex for the brain to resolve (the cocktail party effect). In such cases there might exist other processing strategies which are better than adding HRTF information to the transceiver input signal(s).

For example, transceiver gain(s) may be applied after the HRTF information has been added to the respective M transceiver input signals $x_i(n)$. In this case, the output Y(n) from the pre-processing unit would be given as:

$$Y(n)=hrir_1(\theta,n)*x_1(n)G_1(\theta)+hrir_2(\theta,n)*x_2(n)G_2(\theta)+\ldots+hrir_M(\theta,n)*x_M(n)G_M(\theta)$$

Where hrir is the time domain representation of the HRTF, (*) is the convolution operator and $G_i(\Theta)$ is the transceiver gain for respective transceiver input signal $x_i(n)$ based on the estimated head direction.

The transceiver input signal may comprise a first transceiver input signal originating from the first external source and/or a second transceiver input signal originating from a second external source. To apply a processing scheme may comprise to apply a first transceiver gain to the first transceiver input signal and/or a second transceiver gain to the second transceiver input signal. To apply a processing scheme may comprise to apply a common transceiver gain to the first transceiver input signal and to the second transceiver input signal. In the hearing device, to apply a transceiver gain to the transceiver input signal in the pre-processing unit may comprise to apply a first transceiver gain to a first transceiver input signal of the transceiver input signal and/or to apply a second transceiver gain to a second transceiver input signal of the transceiver input signal based on the first head direction and/or the second head direction. Thus, the hearing device may be able to separately handle wireless streaming from a plurality of external sources, e.g. by applying different first and second transceiver gains. Accordingly, the pre-processing control signal may be indicative of a common transceiver gain for the transceiver input signal or a first transceiver gain for the first transceiver input signal. In case the transceiver input signal comprises a second transceiver input signal, the pre-processing control signal may be indicative of a second transceiver gain for the second transceiver input signal.

In the hearing device, to apply a processing scheme may comprise to apply a first microphone gain to the first microphone input signal in the pre-processing unit and/or to apply a second microphone gain to the second microphone input signal in the pre-processing unit, e.g. based on the first head direction and/or the second head direction. Thus, the hearing device may be able to mute or attenuate the microphone(s) in order for a hearing aid user to focus on transceiver input signal(s) from external source(s), e.g. if a user focusses his attention on a TV with a wireless streaming unit. The pre-processing control signal may be indicative of a common microphone gain for the microphone input signal(s) or a separate microphone gain for one or more of the microphone input signals. For example, the pre-processing control signal may be indicative of a first microphone gain for the first microphone input signal and/or a second microphone gain for the second microphone input signals.

The hearing device may comprise a beamformer. To apply a processing scheme optionally comprises to apply a directional mode to microphone input signal(s), such as one or more pre-processed microphone input signals, in the beamformer, e.g. a first directional mode in a first processing scheme and/or a second directional mode in a second processing scheme. The processing controller may control the beamformer based on the head direction, e.g. via a beamformer control signal in order to control or set a directional mode of the beamformer.

In the hearing device, to apply a processing scheme based on the head direction may comprise to apply a first processing scheme in the hearing device if the head direction is within a first angular range and/or to apply a second processing scheme different from the first processing scheme if the head direction is within a second angular range.

For example, the hearing device may apply a first processing scheme if the first head direction relative to the first external source is indicative of the user turning his head in a direction corresponding to a position of the first external source. Further, or as an alternative, the hearing device may apply a second processing scheme if the first head direction relative to the first external source is indicative of the user turning his head in a direction away or different from a position of the first external source. The second processing scheme may be an omnidirectional mode, i.e. a beamformer in the hearing device applies a second directional mode being an omnidirectional mode.

The hearing device, e.g. the processing controller, may comprise a voice activity detector configured to detect voice activity of one or more external sources, such as first voice activity (VA1) of the first external source and/or second voice activity (VA2) of a second external source. The hearing device, e.g. the processing controller, may be configured to select and apply a processing scheme based on the first voice activity of the first external source (e.g. select one processing scheme if the first voice activity is less than a first primary threshold and/or select another processing scheme if the first voice activity is larger than a first secondary threshold) and/or based on the second voice activity of the second external source (e.g. select one processing scheme if the second voice activity is less than a second primary threshold and/or select another processing scheme if the second voice activity is larger than a second secondary threshold). The hearing device, e.g. the processing controller, may be configured to select and apply a first processing scheme if the based on the first voice activity of the first external source and/or based on the second voice activity of the second external source.

Exemplary parameters of processing schemes PS1-PS8 are indicated in the following Table 1, wherein V1 is the first head direction relative to the first external source, VA1 is the first voice activity, GT1 is the first transceiver gain applied to the first transceiver input signal in the pre-processing unit. V2 is the second head direction relative to the second external source (if present), VA2 is the second voice activity, and GT2 is the second transceiver gain applied to the second transceiver input signal in the pre-processing unit. GM1 is the first microphone gain applied to the first microphone input signal, GM2 is the second microphone gain applied to the second microphone input signal, and DM is the directional mode applied to pre-processed microphone input signals in the beamformer. AR1 is a first angular range, such as from −30° to 30° and AR2 is a second angular range, such as from 30° to 330°. DM1 is a first directional mode and DM2 is a second directional mode. The second directional mode DM2 is an omni-directional mode and different from DM1.

TABLE 1

Parameters of exemplary processing schemes.

| | PS1 | PS2 | PS3 | PS4 | PS5 | PS6 |
|---|---|---|---|---|---|---|
| V1 | AR1 | AR2 | AR1 | AR2 | AR1 | AR1 |
| VA1 | N/A | N/A | N/A | N/A | N/A | "low" |
| GT1 | 1 | <0.5 | 1 | <0.5 | 1 | 1 |
| V2 | N/A | N/A | AR1 | AR2 | AR2 | N/A |
| VA2 | N/A | N/A | N/A | N/A | N/A | N/A |
| GT2 | N/A | N/A | 1 | <0.5 | <0.5 | N/A |
| GM1 | <0.8 | 1 | <0.8 | 1 | 1 | 1 |
| GM2 | <0.8 | 1 | <0.8 | 1 | 1 | 1 |
| DM | DM1 | DM2 | DM1 | DM2 | DM2 | DM2 |

In one or more exemplary hearing device, the first angular range may be from −60° to 60°, such as from −45° to 45°, or from −30° to 30°.

In one or more exemplary hearing device, the second angular range may be from 60° to 300°, such as from 45° to 315°, or from 30° to 330°.

In the method, estimating a head direction may be based on the transceiver input signal and one or more microphone input signals, such as the first microphone input signal and/or a second microphone input signal from a second microphone.

In the method, applying a processing scheme may comprise applying a transceiver gain to the transceiver input signal, such as a first transceiver gain to a first transceiver input signal and/or a second transceiver gain to a second transceiver input signal, in a pre-processing unit of the hearing device. The first transceiver gain and the second transceiver gain may, at least in one processing scheme, be different.

In the method, applying a processing scheme may comprise applying a first microphone gain to the first microphone input signal in a pre-processing unit of the hearing device and/or applying a second microphone gain to a second microphone input signal of a second microphone in a pre-processing unit of the hearing device.

The method may comprise receiving a second wireless input signal of a second external source. The transceiver input signal may comprise a first transceiver input signal originating from the first external source and a second transceiver input signal originating from the second external source, and wherein applying a processing scheme optionally comprises applying a first transceiver gain to the first transceiver input signal and a second transceiver gain to the second transceiver input signal.

In the method, applying a processing scheme may comprise applying a directional mode to the one or more microphone input signals in a beamformer of the hearing device, such as a first directional mode in a first processing scheme and/or a second directional mode in a second processing scheme.

In the method, applying a processing scheme based on the head direction may comprise applying a first processing scheme in the hearing device if the head direction is within a first angular range and/or applying a second processing scheme different from the first processing scheme if the head direction is within a second angular range.

The method may comprise detecting first voice activity of the first external source with a voice activity detector of the hearing device, and selecting and applying a processing scheme based on first voice activity of the first external source.

Throughout, the same reference numerals are used for identical or corresponding parts.

FIG. 1 is a block diagram of an exemplary hearing device according to some embodiments. The hearing device 2 comprises an antenna 4 for converting a first wireless input signal 5 of a first external source (not shown in FIG. 1) to an antenna output signal 6. The hearing device 2 comprises a radio transceiver 7 coupled to the antenna 4 for converting the antenna output signal 6 to one or more transceiver input signals 7A, 7B, 7C and a set of microphones comprising a first microphone 8 and a second microphone 10 for provision of respective first microphone input signal 9 and second microphone input signal 11. The hearing device 2 comprises a pre-processing unit 12 connected to the radio transceiver 7, the first microphone 8 and the second microphone 10 for receiving and pre-processing the transceiver input signal(s) 7A, 7B, 7C, the first microphone input signal 9 and the second microphone input signal 11. The pre-processing unit 12 is configured to pre-process the input signals 7A, 9, 11 and provide pre-processed input signals as output. The hearing device 2 comprises a processor 14 connected to the pre-processing unit 12 for receiving and processing pre-processed input signals comprising one or more pre-processed transceiver input signals 7A', 7B', 7C', pre-processed first microphone input signal 9' and pre-processed first microphone input signal 11'. The processor 14 is configured to compensate for a hearing loss of a user and to provide an electrical output signal 15 based on input signals 7A', 9', 11'. A receiver 16 converts the electrical output signal 15 to an audio output signal to be directed towards an eardrum of the hearing device user. The hearing device 2 comprises a processing controller 18 comprising a direction estimator configured to estimate a head direction of a user of the hearing device, and the hearing device is configured to select and apply a processing scheme based on the head direction. The hearing device 2 selects and applies a processing scheme by the processing controller 18 sending pre-processing control signal 19A to the pre-processing unit 12 and/or processor control signal 19B to the processor 14 based on the head direction.

Figure 2:
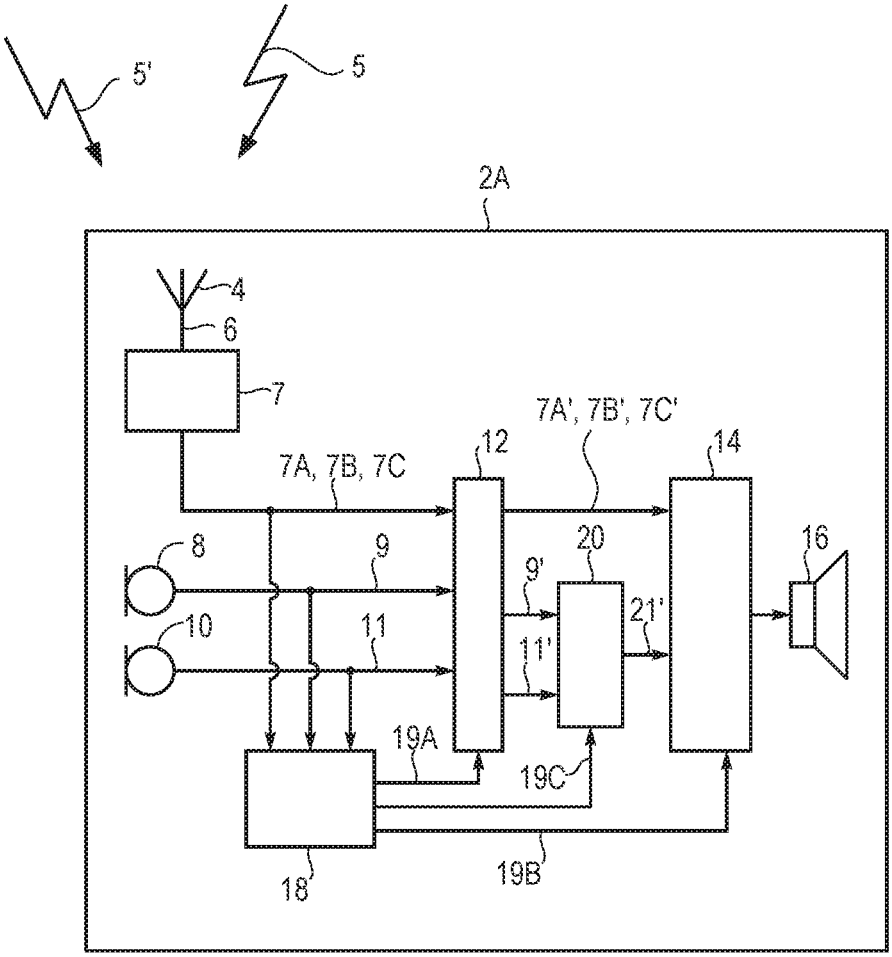
FIG. 2 schematically illustrates an exemplary hearing device.

FIG. 2 is a block diagram of an exemplary hearing device according to the invention. The hearing device 2A is similar to the hearing device 2. Description of features already described in relation to the hearing device 2 will not be repeated. The hearing device 2A comprises a beamformer 20 connected to the pre-processing unit for receiving pre-processed microphone input signals 9', 11'. The beamformer 20 forms a beamformed microphone input signal 21 which is fed to the processor 14 for hearing loss compensation and/or further processing. The beamformer 20 may be controlled by the processing controller 18 via beamformer control signal 19C and/or a control signal from the processor (not shown). For example, the beamformer 20 may be configured to apply a first directional mode in a first processing scheme of the hearing device and to apply the first directional mode or a second directional mode in a second processing scheme based on the beamformer control signal 19C.

Figure 3:
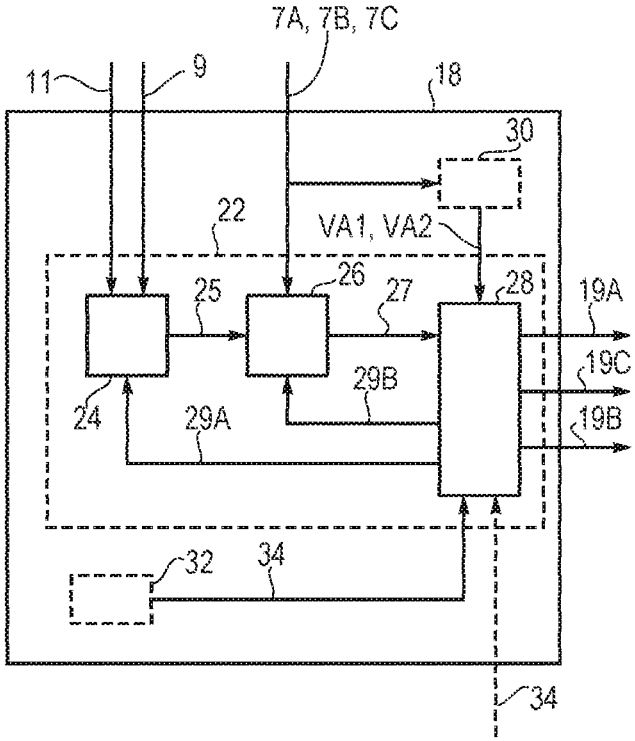
FIG. 3 schematically illustrates an exemplary processing controller.

FIG. 3 shows a block-diagram of an exemplary processing controller. The processing controller 18 comprises a direction estimator 22 configured to estimate a first head direction relative to a first external source. The direction estimator 22 may be configured to estimate a second head direction relative to a second external source, e.g. if the transceiver input signal 7A comprises a second transceiver input signal originating from a second external source. The direction estimator 22 estimates the first head direction and/or the second head direction of a user based on the transceiver input signal 7A, the first microphone input signal 9 and the second microphone input signal 11. The direction estimator 22 comprises an estimation beamformer 24 for provision of beamformed microphone input signal(s) 25. The output of the estimation beamformer is connected to an input of a signal correlation unit 26 for feeding the beamformed microphone input signal(s) to the signal correlation unit 26. Accordingly, the direction estimator 22 comprises a signal correlation unit 26 configured to correlate the transceiver input signal 7A, e.g. including the first transceiver input signal 7B and/or second transceiver input signal 7C, and the beamformed microphone input signal(s) 25 from the estimation beamformer 24. The correlation output 27 of the signal correlation unit 26 is fed to a control unit 28 of the processing controller 18, and the control unit 28 provides one or more control signals 19A, 19B, 19C based on the correlation output. The control unit 28 optionally controls the estimation beamformer 24 by estimation beamformer control signal 29A and/or the signal correlation unit 26 by correlation control signal 29B.

The processing controller 18 optionally comprises a voice activity detector 30 configured to detect first voice activity of the first external source and/or second voice activity of a second external source based on the transceiver input signal 7A, the first transceiver input signal 7B and/or the second transceiver input signal 7C if present. The processing controller 18/controller unit 28 is optionally configured to select and apply a processing scheme based on the first voice activity VA1 of the first external source and/or based on the second voice activity VA2 of the second external source.

The processing controller 18 optionally comprises an accelerometer 32 or receive accelerometer input 34 from an accelerometer and estimate head directions V1 and/or V2 based on accelerometer input to the direction estimator.

Figure 4:
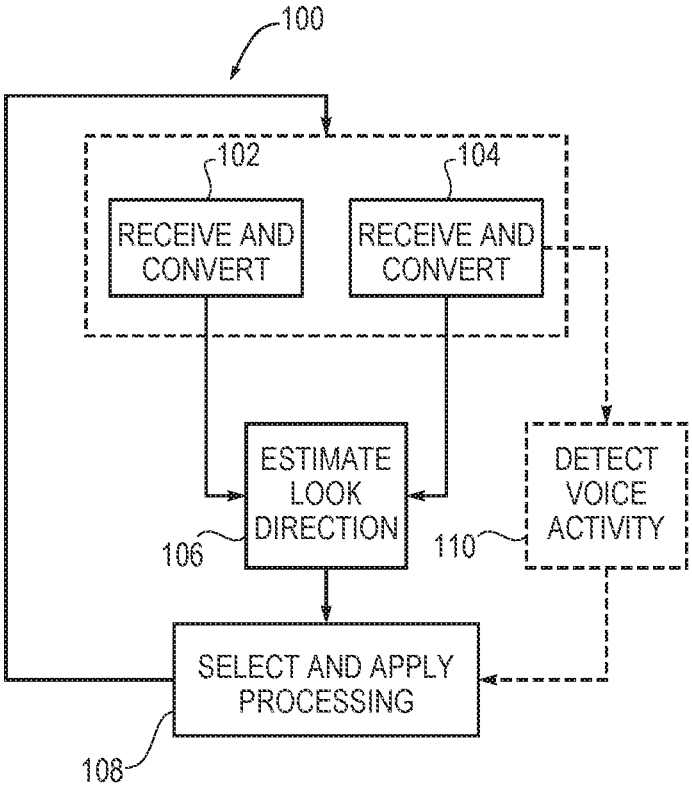
FIG. 4 is a flow diagram of an exemplary method according to some embodiments.

FIG. 4 shows a flow diagram of an exemplary method of operating a hearing device according to the invention. The method 100 comprises receiving input signals 101 comprising receiving 102 a first wireless input signal of a first external source and converting 102 the first wireless input signal to a transceiver input signal and receiving 104 an audio signal and converting 104 the audio signal to one or more microphone input signals including a first microphone input signal. Further, the method comprises estimating 106 a head direction of a user of the hearing device; and selecting and applying 108 a processing scheme based on the head direction. estimating a head direction is based on the transceiver input signal and the first microphone input signal. In the method 100, applying 108 a processing scheme comprises applying a transceiver gain to the transceiver input signal, such as a first transceiver gain GT1 to a first transceiver input signal, in a pre-processing unit of the hearing device. Further, applying 108 a processing scheme comprises applying a first microphone gain MG1 to the first microphone input signal in a pre-processing unit of the hearing device. Optionally, the method 100 comprises receiving 104 a second wireless input signal of a second external source, and wherein the transceiver input signal comprises a first transceiver input signal originating from the first external source and a second transceiver input signal originating from the second external source, and wherein applying 108 a processing scheme comprises applying a first transceiver gain GT1 to the first transceiver input signal and a second transceiver gain GT2 to the second transceiver input signal, see also Table 1. Optionally, applying 108 a processing scheme comprises applying a directional mode to the one or more microphone input signals in a beamformer of the hearing device.

Optionally, applying 108 a processing scheme based on the head direction comprises applying a first processing scheme in the hearing device if the head direction, such as first head direction V1, is within a first angular range and applying a second processing scheme different from the first processing scheme if the head direction, such as first head direction V1, is within a second angular range. Further, the method optionally comprises detecting 110 first voice activity of the first external source with a voice activity detector of the hearing device, e.g. based on the (first) transceiver input signal, and selecting and applying 108 a processing scheme based on first voice activity of the first external source.

Figure 5:
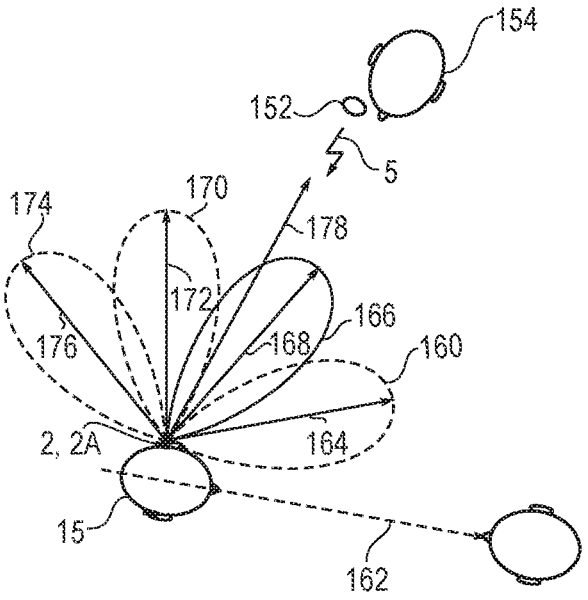
FIG. 5 illustrates an example of head direction estimation.

FIG. 5 shows a schematic illustration of an exemplary estimation of a head direction, where a hearing device user with a hearing device 2, 2A receives a first wireless input signal 5 from a first external device (spouse microphone) 152 worn by first speaker 154. An estimation beamformer of the hearing device applies four different estimation modes including first estimation mode 160 with main loop in first direction 164 (with angle of about −20 degrees relative to zero direction 162 of the hearing device user), second estimation mode 166 with main loop in second direction 168 (with angle of about −60 degrees relative to zero direction 162 of the hearing device user), third estimation mode 170 main loop in third direction 172 (with angle of about −100 degrees relative to zero direction 162 of the hearing device user), and fourth estimation mode 174 with main loop in fourth direction 176 (with angle of about −140 degrees relative to zero direction 162 of the hearing device user). Beamformed microphone input signal(s) corresponding to respective estimation modes are fed to the signal correlation unit of the hearing device correlating the beamformed microphone input signal(s) with first transceiver input signal converted from the first wireless input signal 5, the signal correlation unit feeding correlation output including correlation values (CV1, CV2, CV3, CV4) resulting from the signal correlation to the control unit of the processing controller. The correlation value CV1 is the result of the correlation between the transceiver input signal and the beamformed microphone input signal(s) corresponding to the first estimation mode, CV2 is the result of the correlation between the transceiver input signal and the beamformed microphone input signal(s) corresponding to the second estimation mode, CV3 is the result of the correlation between the transceiver input signal and the beamformed microphone input signal(s) corresponding to the third estimation mode, and CV4 is the result of the correlation between the transceiver input signal and the beamformed microphone input signal(s) corresponding to the fourth estimation mode. The control unit of the processing controller estimates the head direction based on the correlation values (CV1, CV2, CV3, CV4), e.g. as the main loop direction of the estimation mode with the highest correlation value. In the illustrated example, the second correlation value CV2 is the largest correlation value and the head direction may be determined or estimated to the second direction, i.e. about −60 degrees. In one or more exemplary hearing devices, the control unit identifies the head direction as a weighting or interpolation based on correlation values (CV1, CV2, CV3, CV4) and/or main loop directions of one or more estimation modes, for example the two or three estimation modes resulting in the highest (or lowest) correlation values. Thus, in the illustrated example, the third correlation value CV3 is the second largest cross correlation value and the hearing device may determine the head direction as a weighting based on the third cross correlation value CV3 and the second correlation value CV2.

For example, the estimated head direction HD may in one or more exemplary hearing devices be given as:

$$HD=a_1 \cdot HD_1+a_2 \cdot HD_2,$$

where $a_1$ and $a_2$ are weighting coefficients based on a primary correlation value selected from the correlation values, e.g. the highest (or lowest) correlation value, and a secondary correlation value selected from the correlation values, e.g. the second-highest (or second-lowest) correlation value. HD1 and HD2 are main loop directions of respective primary correlation value and secondary correlation value relative to the zero direction.

For the example illustrated in FIG. 5, given exemplary correlation values CV1=0.4, CV2=0.8, CV3=0.6, CV4=0.3, the head direction HD may be given as:

$$HD = a_1 \cdot HD_1 + a_2 \cdot HD_2 = \frac{CV_2}{(CV_3 + CV_2)} \cdot HD_1 + \frac{CV_3}{(CV_3 + CV_2)} \cdot HD_2$$

Since the second correlation value (CV2=0.8 with HD1=−60 degrees) is the highest correlation value and the third correlation value (CV2=0.6 with HD2=−110 degrees) is the second-highest correlation value, resulting in an estimated head direction 178 of about −77 degrees. In the present context, the correlation value is in the range from 0 to 1 where a correlation value of 0 indicates no correlation and a correlation value of 1 indicates full correlation. Other correlation value schemes may of course be employed without departing from the present invention.

Figure 6:
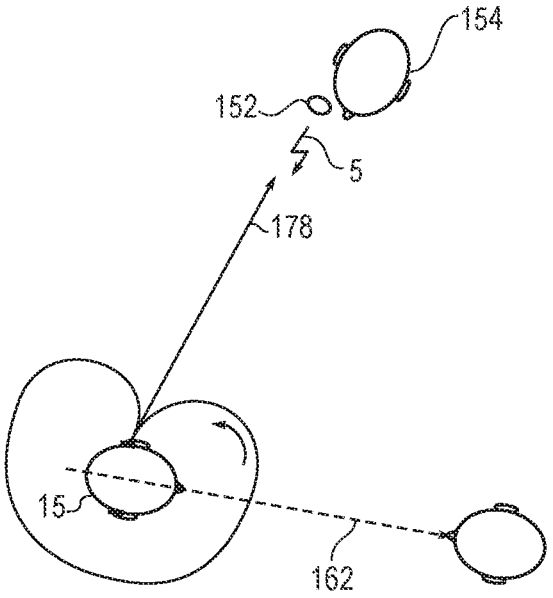
FIG. 6 illustrates an example of head direction estimation.

FIG. 6 shows a schematic illustration of an exemplary estimation of a head direction, where a hearing device user with a hearing device 2, 2A receives a first wireless input signal 5 from a first external device (spouse microphone) 152 worn by first speaker 154. Control unit of the processing controller is configured to estimate a head direction based on an adaptive beamforming scheme, where the control unit controls the estimation beamformer (estimation mode parameters) in order to cancel a reference signal, e.g. by minimizing a correlation value of correlation output, the correlation value being the result of signal correlation between a beamformed microphone input signal and a transceiver input signal, the control unit controlling the adaptive estimation mode 180 (and thereby a direction 162 that can be identified as the head direction) applied in the estimation beamformer. The estimated head direction 178 is then the direction of the estimation mode providing the best cancellation of the reference signal.

Figure 7:
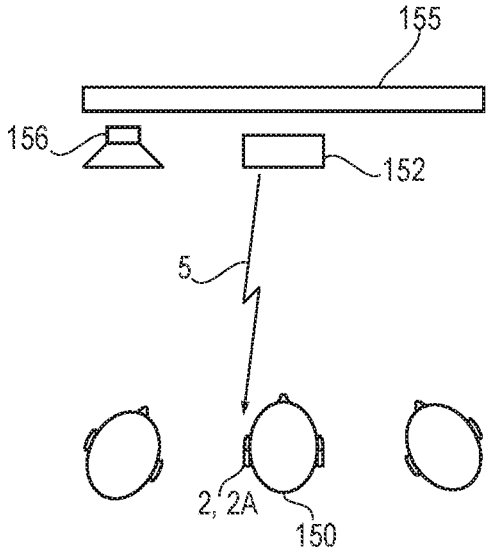
FIG. 7 illustrates a user situation for a user watching television.
Figure 8:
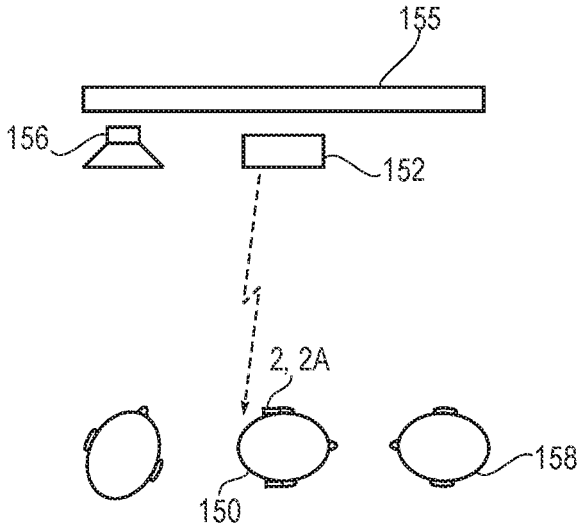
FIG. 8 illustrates a user situation for a user watching television

FIGS. 7 and 8 illustrates operation of the hearing device for a user watching television 155 with a first external device 152 being a wireless TV transmitter streaming a first wireless input signal 5 representative of TV audio to the hearing device user 150. The television also comprises one or more loudspeakers 156 outputting TV audio. When the hearing device user turns his/her head in the direction of the television (head direction about zero) as illustrated in FIG. 7, the output of the hearing aid is mainly the streamed TV audio, e.g. by setting GT1=1 and/or (GM1<0.9 and GM2<0.9). When the hearing device user turns his/her head in the direction of a person or other audio source 158 (head direction about −85 degrees), the streamed TV audio is attenuated and the output of the hearing aid is mainly based on the microphone input signal(s), e.g. beamformed microphone input signal. For example, in FIG. 8 the hearing device/processing controller may set GT1<0.5 and/or (GM1=1 and GM2=1).

Figure 9:
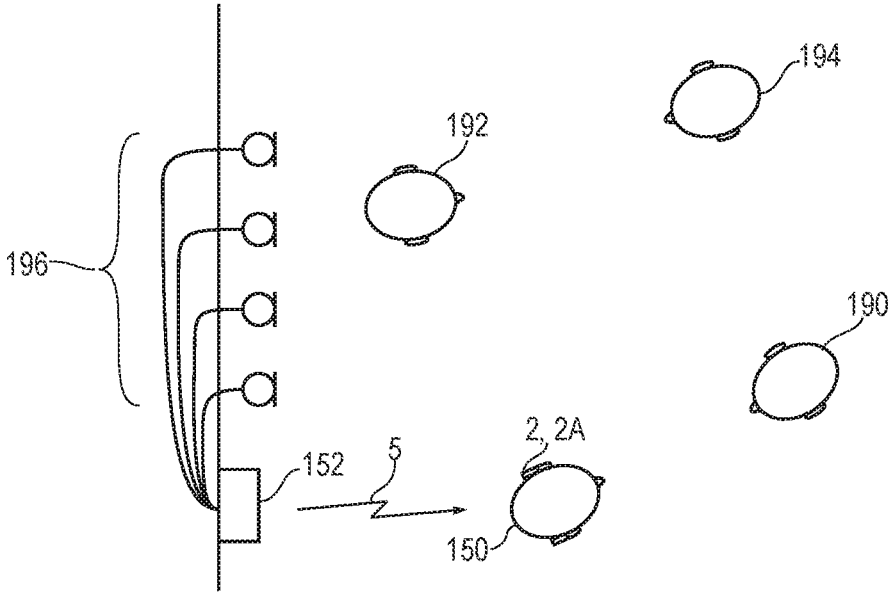
FIG. 9 illustrates a user situation for a user in a multi-source environment.
Figure 10:
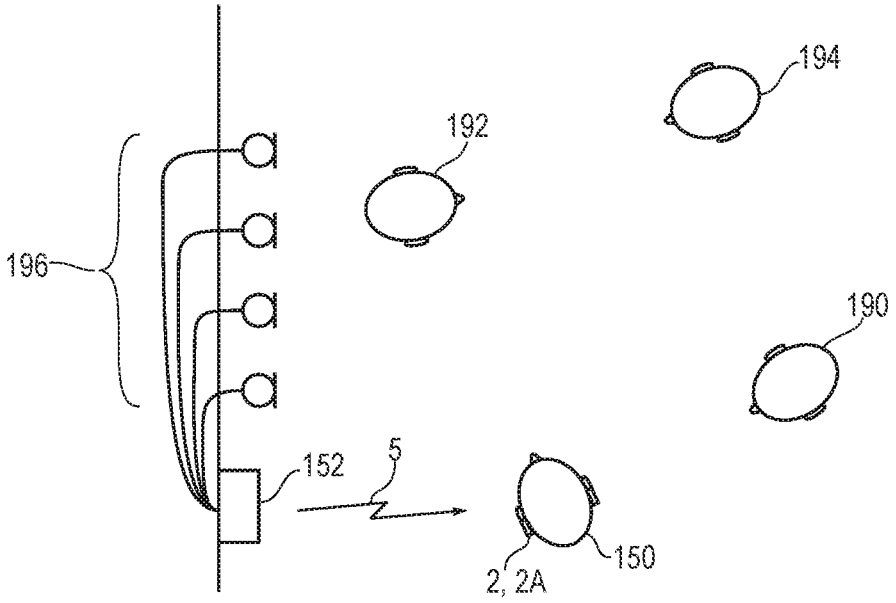
FIG. 10 illustrates a user situation for a user in a multi-source environment.

FIGS. 9 and 10 illustrate operation of an exemplary hearing device, wherein audio from audio sources 190, 192, 194 is recorded by a microphone array 196 and is separated in the first external device 152 into first wireless input signal 5. The radio transceiver of the hearing device 2, 2A separates the first wireless input signal 5 into three transceiver input signals, the transceiver input signals being representative of audio from respective audio sources/speakers 190, 192, 194. In FIG. 9, the output of the hearing aid is mainly the first transceiver input signal representative of the audio of the first sound source/speaker 190, (e.g. by setting GT1=1 and/or (GT2<0.5 and GT3<0.8). In FIG. 10, the output of the hearing aid is mainly the second transceiver input signal representative of the audio of the second sound source/speaker 192, (e.g. by setting GT2=1 and/or (GT1<0.5 and GT3<0.8).

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2, 2A hearing device
4 antenna
5 first wireless input signal
5' second wireless input signal
6 antenna output signal
7 radio transceiver
7A transceiver input signal
7B first transceiver input signal
7C second transceiver input signal
7A' pre-processed transceiver input signal
7B' pre-processed first transceiver input signal
7C' pre-processed second input signal
8 first microphone
9 first microphone input signal
9' pre-processed first microphone input signal
10 second microphone
11 second microphone input signal
11' pre-processed second microphone input signal
12 pre-processing unit
14 processor
15 electrical output signal
16 receiver
18 processing controller
19A pre-processing control signal
19B processor control signal
19C beamformer control signal
20 beamformer
21 beamformed microphone input signal
22 direction estimator
24 estimation beamformer
25 beamformed microphone input signal(s)
26 signal correlation unit
27 correlation output
28 control unit
29A estimation beamformer control signal
29B correlation control signal
30 voice activity detector
32 accelerometer
34 accelerometer input
100 method of operating a hearing device
101 receiving and converting input signals
102 receiving and converting a first wireless input signal and/or a second wireless input signal
104 receiving and converting an audio signal
106 estimating head direction
108 selecting and applying processing scheme
110 detecting first voice activity
150 hearing device user
152 first external device
154 first speaker
155 Television
156 TV loudspeaker
160 first estimation mode
162 zero direction
164 first direction
166 second estimation mode
168 second direction
170 third estimation mode
172 third direction
174 fourth estimation mode
176 fourth direction
178 estimated head direction
180 adaptive estimation mode
190 first audio source/speaker
192 second audio source/speaker
194 third audio source/speaker
196 microphone array
VA1 first voice activity
VA2 second voice activity
GT1 first transceiver gain
GT2 second transceiver gain
GT3 third transceiver gain
GM1 first microphone gain
GM2 second microphone gain
CV1 first correlation value
CV2 second correlation value
CV3 third correlation value
CV4 fourth correlation value

The invention claimed is:

1. A hearing device comprising:
an antenna for converting a first wireless input signal of a first external source to an antenna output signal;
a radio transceiver coupled to the antenna for converting the antenna output signal to a transceiver input signal;
a set of microphones comprising a first microphone for provision of a first microphone input signal;
a pre-processing unit connected to the radio transceiver and the first microphone for pre-processing the transceiver input signal and the first microphone input signal;
a processor for processing input signals and providing an electrical output signal based on the input signals;
a receiver for converting the electrical output signal to an audio output signal; and
a processing controller comprising a direction estimator configured to estimate a head direction of interest for a user of the hearing device, wherein the estimated head direction of interest is different from an actual head direction of the user of the hearing device at a time when the head direction of interest is estimated;
wherein the hearing device is configured to select and apply a processing scheme in the hearing device after the head direction of interest is estimated.

2. The hearing device according to claim 1, wherein the direction estimator is configured to estimate the head direction of the user of the hearing device based on the transceiver input signal and the first microphone input signal.

3. The hearing device according to claim 1, wherein the direction estimator is configured to estimate the head direction relative to the first external source.

4. The hearing device according to claim 1, wherein the hearing device is configured to apply the processing scheme in the hearing device by applying a transceiver gain to the transceiver input signal in the pre-processing unit.

5. The hearing device according to claim 1, wherein the hearing device is configured to apply the processing scheme in the hearing device by applying a first microphone gain to the first microphone input signal in the pre-processing unit.

6. The hearing device according to claim 1, wherein the transceiver input signal comprises a first transceiver input signal associated with the first external source and a second transceiver input signal associated with a second external source; and wherein the hearing device is configured to apply the processing scheme in the hearing device by applying a first transceiver gain to the first transceiver input signal and a second transceiver gain to the second transceiver input signal.

7. The hearing device according to claim 1, further comprising a beamformer, wherein the hearing device is configured to apply the processing scheme by applying a directional mode to microphone signal(s) in the beamformer.

8. The hearing device according to claim 1, further comprising a voice activity detector configured to detect first voice activity associated with the first external source;

wherein the hearing device is configured to select and apply the processing scheme in the hearing device based on the first voice activity associated with the first external source.

9. The hearing device according to claim 1, wherein the estimated head direction of interest is a predicted head direction.

10. The hearing device according to claim 1, wherein the hearing device is configured to select and apply the processing scheme in the hearing device based on the estimated head direction.

11. The hearing device according to claim 10, wherein the hearing device is configured to apply the processing scheme based on the estimated head direction by applying a first processing scheme in the hearing device if the estimated head direction is within a first angular range, and applying a second processing scheme in the hearing device different from the first processing scheme if the estimated head direction is within a second angular range.

12. A method of operating a hearing device, comprising:

receiving a first wireless input signal of a first external source and converting the first wireless input signal to a transceiver input signal;

receiving an audio signal and converting the audio signal to one or more microphone input signals including a first microphone input signal;

estimating a head direction of interest for a user of the hearing device, wherein the estimated head direction of interest is different from an actual head direction of the user of the hearing device at a time when the head direction of interest is estimated; and selecting and applying a processing scheme in the hearing device after the head direction of interest is estimated.

13. The method according to claim 12, wherein the act of estimating the head direction is performed based on the transceiver input signal and the first microphone input signal.

14. The method according to claim 12, wherein the act of applying the processing scheme comprises applying a transceiver gain to the transceiver input signal in a pre-processing unit of the hearing device.

15. The method according to claim 12, wherein the act of applying the processing scheme comprises applying a first microphone gain to the first microphone input signal in a pre-processing unit of the hearing device.

16. The method according to claim 12, further comprising receiving a second wireless input signal of a second external source;

wherein the transceiver input signal comprises a first transceiver input signal originating associated with the first external source and a second transceiver input signal associated with the second external source; and wherein the act of applying the processing scheme comprises applying a first transceiver gain to the first transceiver input signal and a second transceiver gain to the second transceiver input signal.

17. The method according to claim 12, wherein the estimated head direction of interest is a predicted head direction.

18. The method according to claim 12, wherein the processing scheme in the hearing device is applied based on the estimated head direction of interest.

19. The method according to claim 18, wherein the act of applying the processing scheme based on the estimated head direction comprises:

applying a first processing scheme in the hearing device if the estimated head direction is within a first angular range, and applying a second processing scheme different from the first processing scheme if the estimated head direction is within a second angular range.

* * * * *